US006767295B2

(12) United States Patent
Kennedy, III

(10) Patent No.: US 6,767,295 B2
(45) Date of Patent: Jul. 27, 2004

(54) UNDERCUT DIMPLES FOR A GOLF BALL

(75) Inventor: Thomas J. Kennedy, III, Wilbraham, MA (US)

(73) Assignee: Callaway Golf Company, Carlsbad, CA (US)

( * ) Notice: Subject to any disclaimer, the term of this patent is extended or adjusted under 35 U.S.C. 154(b) by 284 days.

(21) Appl. No.: 09/730,867

(22) Filed: Dec. 6, 2000

(65) Prior Publication Data

US 2002/0068648 A1 Jun. 6, 2002

(51) Int. Cl.[7] ..... A63B 37/12; A63B 37/14
(52) U.S. Cl. ..... 473/383; 473/378
(58) Field of Search ..... 473/378–383

(56) References Cited

U.S. PATENT DOCUMENTS 1,795,732 A * 3/1931 Miller ..... 40/327
4,787,638 A * 11/1988 Kobayashi ..... 473/383
5,143,377 A * 9/1992 Oka et al. ..... 40/327
5,174,578 A * 12/1992 Oka et al. ..... 473/383
5,338,039 A 8/1994 Oka et al.
5,470,076 A 11/1995 Cadorniga
5,503,398 A * 4/1996 Lu ..... 473/384
5,695,414 A 12/1997 Yokota
5,800,287 A 9/1998 Yokota et al.
5,842,937 A 12/1998 Dalton et al.
5,857,924 A 1/1999 Miyagawa et al.

OTHER PUBLICATIONS

Hotchkiss, John, 500 Years of Golf Balls: History & Collector's Guide. Iowa: Antique Trader Books, copyright 1997, pp. 78–80, 115–123.*

* cited by examiner

*Primary Examiner*—Stephen P. Garbe
*Assistant Examiner*—Alvin A. Hunter, Jr.

(57) ABSTRACT

A new configuration for at least some of the dimples on the surface of a golf ball is characterized by undercut portions in the concave surface thereof. The undercut dimples have a first diameter at the surface of the golf ball and a second diameter beneath the surface which is greater than the first diameter. Thus, a portion of the ball surface overhangs an annular portion of the dimple at the periphery thereof. The undercut portions create additional turbulence at the surface of the golf ball as it flies through the air to improve the aerodynamic efficiency of the dimples, thereby reducing drag and increasing the distance the ball will travel when struck.

9 Claims, 1 Drawing Sheet

UNDERCUT DIMPLES FOR A GOLF BALL

BACKGROUND OF THE INVENTION

The present invention relates to a new dimple configuration for a golf ball which increases turbulence at the surface of the ball to reduce drag and increase the distance the ball will travel when struck.

According to the United States Golf Association (U.S.G.A.) rules, a golf ball may not have a weight in excess of 1.620 ounces or a diameter smaller than 1.680 inches. The initial velocity of balls conforming to U.S.G.A. regulations may not exceed 250 feet per second with a maximum tolerance of 2%. Initial velocity is measured on a standard machine kept by the U.S.G.A. A projection on a wheel rotating at a defined speed hits the test ball, and the length of time it takes the ball to traverse a set distance after impact is measured. U.S.G.A. regulations also require that a ball not travel a distance greater than 280 yards when hit by the U.S.G.A. outdoor driving machine under specified conditions. In addition to this specification, there is a tolerance of plus 4% and a 2% tolerance for test error.

These specifications limit how far a struck golf ball will travel in several ways. Increasing the weight of a golf ball tends to increase the distance it will travel and lower the trajectory. A ball having greater momentum is better able to overcome drag. Reducing the diameter of the ball also has the effect of increasing the distance it will travel when hit. This is believed to occur primarily because a smaller ball has a smaller projected area and, thus, a lower drag when traveling through the air. Increasing initial velocity increases the distance the ball will travel.

Drag on a golf ball is also reduced by forming a plurality of dimples, often circular, in the outer surface of the ball. The dimples serve to reduce the pressure differential between the front and rear of the ball as it travels through the air.

BRIEF DESCRIPTION OF THE PRIOR ART

Numerous dimple configurations for use on golf balls are well-known in the patented prior art, including contoured dimples. For example, the Oka et al U.S. Pat. No. 5,338,039 discloses a golf ball having a plurality of polygonal dimples which have a double slope in section so that the dimples appear to have an inner configuration matching that of the polygon. The Cadorniga U.S. Pat. No. 5,470,076 discloses a golf ball having a plurality of dimples with major and minor portions in the manner of a dimple within a dimple. The major portion has a first spherical span and the minor portion has a second spherical span less than the first span, with the minor portion being arranged within the major portion. Both the Oka et al and Cadorniga dimple designs are to improve the flight and aerodynamic performance of the ball.

The present invention was developed in order to increase the turbulence of air at the surface of the golf ball to reduce laminar flow resulting in less drag on the ball. The ball will therefore travel further when struck by a golf club.

SUMMARY OF THE INVENTION

Accordingly, it is a primary object of the present invention to provide a golf ball having a spherical surface including a plurality of dimples arranged in the surface. A first group of dimples in the ball surface has an undercut configuration and a second group of dimples has a circular configuration. The undercut dimples include an outer edge defining a geometric configuration, preferably circular, at the intersection with the spherical surface and a concavity in the ball surface, the diameter of the outer edge being less than the diameter of a portion of the concavity beneath the outer edge. The undercut portion increases the turbulence at the golf ball surface to reduce the laminar flow and drag thereon so that the golf ball will travel a greater distance when struck by a golf club.

According to another object of the invention, an acute angle is defined between the surface of the golf ball and a surface defining the undercut portion of the undercut dimple.

According to a further object of the invention, there are a greater number of undercut dimples than circular dimples in the surface of the golf ball.

BRIEF DESCRIPTION OF THE FIGURES

These and other objects according to the invention will become apparent from a study of the following specification when viewed in the light of the accompanying drawing, in which.

DETAILED DESCRIPTION

Figure 1:
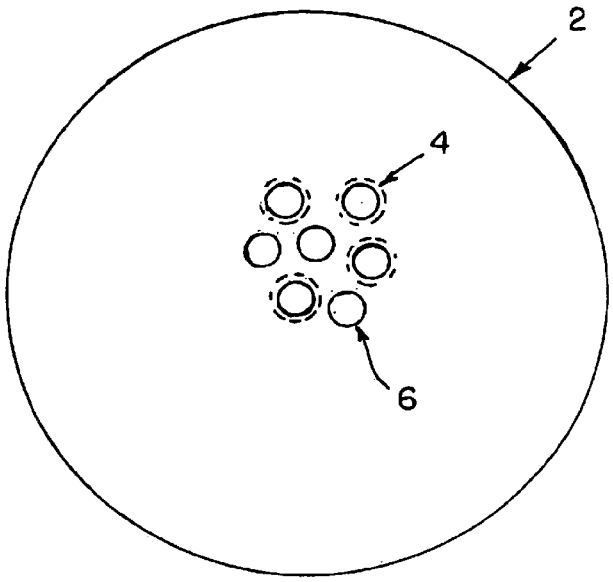
FIG. 1 is plan view of a golf ball including a plurality of first undercut and second circular dimples according to the invention.

In FIG. 1, there is shown a golf ball 2 having a spherical surface which contains a plurality of first undercut dimples 4 and second circular dimples 6. Both the first and second dimples preferably have a circular configuration, but other configurations such as ellipses and ovals may be provided. The circular geometric configuration of the dimples is defined where the dimple intersects with the surface of the ball. The dimples may all be of the same diameter, or different diameter dimples may be provided.

Figure 2:
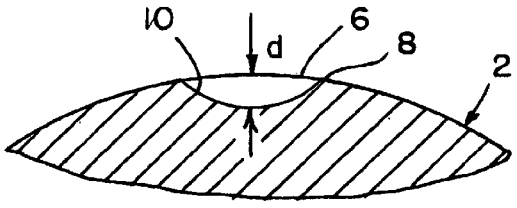
FIG. 2 is a sectional view of a circular dimple according to the invention.

Referring to FIG. 2, each circular dimple 6 of the second plurality of dimples includes an outer edge 8 having a circular geometric configuration and a concave bottom surface 10 in the golf ball. The circular dimples 6 have a depth d extending from the surface of the golf ball to the lowermost portion of the bottom surface.

Figure 3:
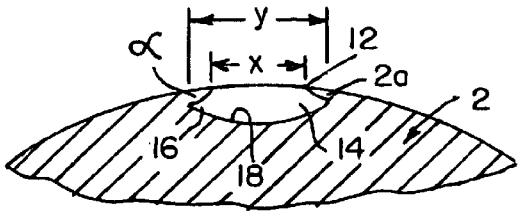
FIG. 3 is a sectional view of an undercut dimple according to the invention.

The golf ball 2 further contains a first plurality or group of undercut dimples 4. As best shown in FIG. 3, an undercut dimple includes an outer edge 12 defining a geometric configuration such as a circle at the intersection with the spherical surface of the ball and a concavity 14 in the ball surface. The diameter x of the undercut dimple 4 is measured across the dimple between the edges thereof. Beneath the outer surface, the concavity 14 has a greater diameter y than the diameter x at the surface. The dimple thus includes an undercut portion 16 beneath an overhanging portion 2*a* of the golf ball surface. An acute angle $\alpha$ is defined between the surface of the ball and a surface defining the undercut portion 16 of the dimple. The concave bottom surface 18 of the dimple thus extends across the diameter y which is greater than the diameter x across the dimple.

The undercut portion 16 of the dimple creates eddy currents as the golf ball travels through the air. These eddy currents increase the turbulence at the surface of the golf ball which reduce the laminar air flow and thus the drag on the ball. Accordingly, the ball will travel a greater distance when struck by a golf club than a golf ball containing only circular dimples.

Preferably, the diameters of the undercut dimples and second dimples is the same. Thus, the ball has a uniform appearance, even though the number of uppercut dimples preferably exceeds the number of second dimples.

The cover layer of the golf ball is formed of any suitable material. For example, the cover may comprise a synthetic plastic material such as a soft ionomer or other elastomer. When the face of a golf club strikes the ball, the overhanging portions 2*a* of the undercut dimples is momentarily compressed by the impact of the club. Once the ball leaves the club face, the overhanging portions spring back to their normal configuration and allow the undercut portions to increase turbulence at the ball surface.

While in accordance with the provisions of the patent statutes the preferred forms and embodiments of the invention have been illustrated and described, it will be apparent to those of ordinary skill in the art that various changes and modifications may be made without deviating from the inventive concepts set forth above.

What is claimed is:

1. A dimple arranged in a spherical surface of a golf ball, comprising an outer edge defining a geometric configuration at the intersection with the spherical surface and a concavity in the ball surface, the diameter of the outer edge being less than the diameter of a portion of said concavity beneath said outer edge, thereby to define an undercut portion of the dimple beneath the surface of the golf ball, said undercut portion increasing the turbulence at the golf ball surface to reduce drag and increase the distance the ball will travel when struck.

2. A dimple as defined in claim 1, wherein an acute angle is defined between the surface of the golf ball and a surface defining said undercut portion of the dimple.

3. A dimple as defined in claim 2, wherein said geometric configuration defined by the dimple outer edge is a circle.

4. A dimple as defined in claim 3, wherein said undercut portion has a circular configuration at a location of maximum diameter thereof.

5. A golf ball having a spherical surface containing a plurality of dimples, at least one of said dimples comprising an undercut dimple including an outer edge defining a geometric configuration at the intersection with the spherical surface and a concavity in the ball surface, the diameter of the outer edge being less than the diameter of a portion of said concavity beneath said outer edge, thereby to define an undercut portion of the dimple beneath the surface of the golf ball, said undercut portion increasing the turbulence at the golf ball surface to reduce drag and increase the distance the ball will travel when struck.

6. A golf ball as defined in claim 5, wherein an acute angle is defined between the surface of the golf ball and a surface defining said undercut portion of said undercut dimple.

7. A golf ball as defined in claim 6, and further comprising at least one second dimple having a concavity without an undercut portion.

8. A golf ball as defined in claim 7, wherein said undercut dimple and said second dimple both have a circular configuration at the intersection thereof with the golf ball surface.

9. A golf ball as defined in claim 8, wherein a greater number of undercut dimples is provided in the golf ball surface than second dimples.

* * * * *